US005348303A

United States Patent [19]

Swissheim

[11] Patent Number: 5,348,303

[45] Date of Patent: Sep. 20, 1994

[54] GOLF CLUB GRIP

[75] Inventor: Charles T. Swissheim, Tustin, Calif.

[73] Assignee: Bullet Golf Ball, Inc., Santa Ana, Calif.

[21] Appl. No.: 16,994

[22] Filed: Feb. 12, 1993

[51] Int. Cl.[5] ..... A63B 69/36
[52] U.S. Cl. ..... 273/187.5
[58] Field of Search ..... 273/187.2, 81 B, 81.4, 273/187.5, 187.4; D21/222

[56] References Cited

U.S. PATENT DOCUMENTS

| | | | |
|---|---|---|---|
| D. 315,006 | 2/1991 | Solheim | D21/222 |
| D. 336,322 | 6/1993 | Poincenot et al. | D21/222 |
| 1,587,082 | 6/1926 | Mattern | 273/81 B |
| 3,848,874 | 11/1974 | Elkins | 273/187.5 X |
| 4,974,846 | 12/1990 | Fenton | 273/81 B |
| 5,087,042 | 2/1992 | Solheim | 273/81 B |
| 5,248,141 | 9/1993 | Kelly | 273/187.5 X |
| 5,261,665 | 11/1993 | Downey | 273/81 B |

OTHER PUBLICATIONS

"The Golf Works 1992 Catalog", Ralph Maltby Enterprise, Inc. pp. 1-61 through 1-69.

*Primary Examiner*—George J. Marlo
*Attorney, Agent, or Firm*—Edward A. Sokolski

[57] ABSTRACT

A first marker which may be in the shape of a diamond is engraved on the outer wall of a golf club grip in a predetermined position spaced from the top end of the grip. A second marker which may be in the form of a diamond smaller than the first marker is engraved on the outer wall of the golf club grip in a predetermined position directly below the first marker. A plurality of elongated vertical grooves are engraved in the outer wall of the grip in the upper portion thereof. For proper gripping of the club, the user grips the golf club grip with one hand (left hand for a right handed person) with four fingers wrapped around the grip and over the vertical grooves and with the thumb placed over the first diamond marker. The other hand is placed over the first hand with only the small finger of the right hand overlapping the index finger of the left hand and grips the lower portion of the grip with the second marker located between the user's thumb and forefinger.

1 Claim, 1 Drawing Sheet

GOLF CLUB GRIP

BACKGROUND OF THE INVENTION

1. Field of the Invention

This invention relates to golf clubs and more particularly to a grip for a golf club which is adapted to facilitate the proper gripping of the club by the user.

2. Description of the Prior Art

To assure proper stroking of a golf club, it is essential that the golf club grip enables firm retention of the club in the user's hand and that the hands be properly positioned on the grip. For a right-handed golfer, the fingers of the left hand are used to control the golf club during the swing, the fingers of such hand firmly gripping the club grip in a manner which avoids any slipping. The right hand is placed over the left hand and grips the lower portion of the golf grip.

Golf club grips of the prior art are often provided with striations, dimples and other types of indentations to improve the friction characteristics thereof. Training grips have been developed in the prior art for teaching the correct hand grip position as described above. One of such training grips known as the Lamkin training grip is shown on page 1-68 of the 1992 GOLFWORKS catalog of Ralph Maltby Enterprises, Inc., Newark, Ohio. The Lamkin grip utilizes a series of recesses in which the fingers of the left hand can be readily fitted and a second portion with a raised section adapted to receive the user's right hand. This device involves a substantial modification of the configuration of the grip and is therefore not legal for USGA play. Further it involves a substantial modification of the shape and contour of the grip which requires a special mold.

SUMMARY OF THE INVENTION

The golf grip of the present invention involves a simple and relatively inexpensive modification of a prior art golf grip which facilitates proper gripping by the user. This modification is achieved without any modification to the shape of a normal grip, so the golf grip of the present invention should be acceptable for USGA play.

The grip of the present invention has a first marker located on the grip in a position where (for a right-handed golfer) the user's left thumb should lie and a second marker in a line with and directly below the first marker which defines a position between the forefinger and thumb of the user's right hand for proper gripping of the club. The markers may be in the form of diamonds, the first of such diamonds being larger than the second. Longitudinal striations are provided in the upper portion of the grip to help avoid slipping of the fingers of the left hand during the swing.

It is therefore an object of this invention to facilitate the proper gripping of a golf club grip.

It is a further object of this invention to provide an improved golf club grip having markers thereon to facilitate the proper placement of one's hands.

Other objects of the invention will become apparent as the description proceeds in connection with the accompanying drawings.

DETAILED DESCRIPTION OF THE INVENTION

Figure 1:
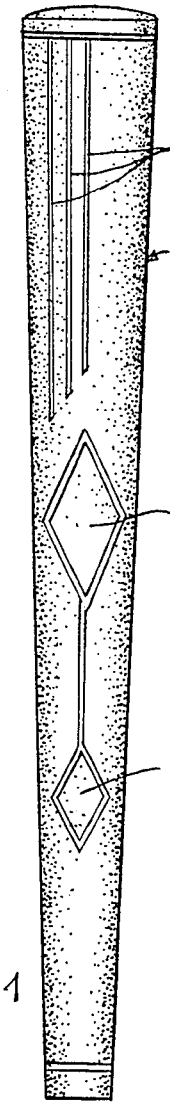
FIG. 1 is a front elevational view of a preferred embodiment of the invention.
Figure 2:
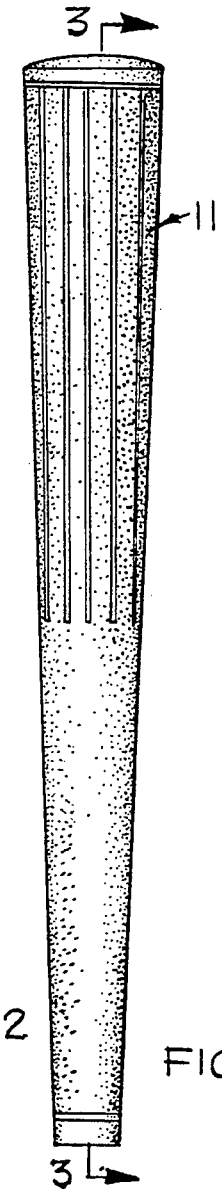
FIG. 2 is a rear elevational view of the preferred embodiment.
Figure 3:
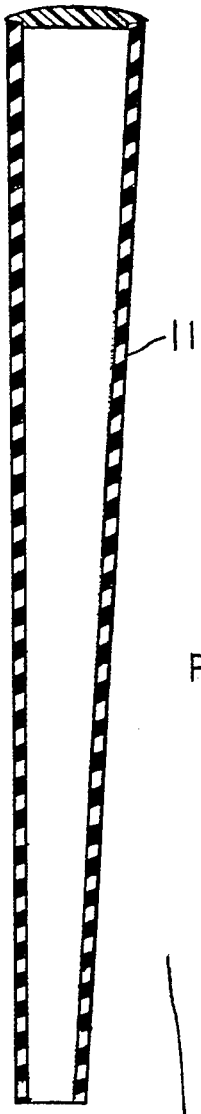
FIG. 3 is a cross-sectional view taken along the plane indicated by 3—3 in FIG. 2.

Referring now to the drawings, a preferred embodiment of the invention is illustrated. The grip 11 is of a conventional tapering tubular shape and is fabricated of an elastic material such as rubber or a suitable plastic. The grip is fitted onto a golf shaft (not shown) in the same manner as prior art grips. A plurality of longitudinal grooves 12 are formed in the upper portion of the grip to provide a good gripping surface.

A first marker 14 which may be in the shape of a diamond is placed on the grip in a location defining the position where the thumb of one of the user's hands should be placed for proper gripping of the grip. A second marker 15 which may be in the shape of a diamond smaller than marker 14 is placed below marker 14 in a location defining the position between the thumb and forefinger of the user's other hand for proper gripping of the grip. Grooves 12 and markers 14 and 15 may be engraved in the grip to ensure their permanency.

Figure 4:
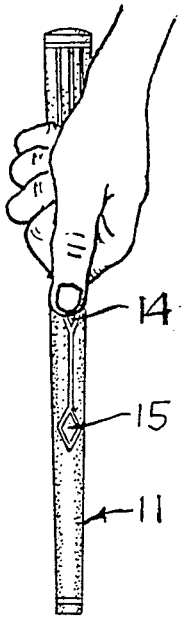
FIG. 4 is a front elevational view illustrating the placement of a user's left hand on the grip of the preferred embodiment.
Figure 5:
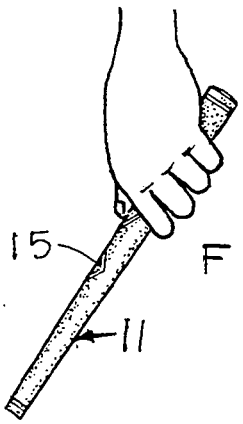
FIG. 5 is a side elevational view illustrating the placement of a user's left hand on the grip of the preferred embodiment.
Figure 6:
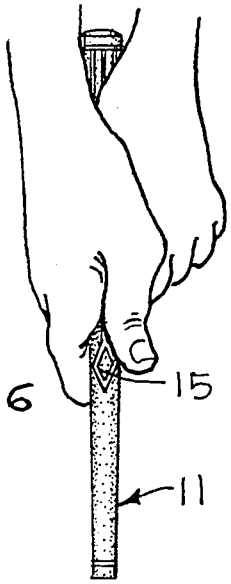
FIG. 6 is a front elevational view illustrating the placement of both of the user's hands on the grip of the preferred embodiment.

Referring particularly to FIGS. 4–6, the method of use of the invention is illustrated. As shown in FIGS. 4 and 5, the user first grasps the upper portion of the grip with one hand (in the case of a right-handed person, the left hand), with four fingers wrapped around grooved portion 12 and with the thumb placed over the diamond marker 14. The user's other hand(right hand in the case of a right-handed person) is then placed over the first hand with the fingers grasping the lower half of the grip and in a position such that the marker 15 is located between the user's thumb and forefinger, as shown in FIG. 6.

The system of the invention thus facilitates the proper placement of a golfer's hands on a golf club grip. This is particularly useful for enabling a neophyte golfer to learn the gripping technique and is also useful for assuring more experienced golfers that their grips are correct. While the invention has been described and illustrated in detail, it is to be clearly understood that this is intended by way of illustration and example only and is not to be taken by way of limitation, the spirit and scope of the invention being limited only by the terms of the following claims.

I claim:

1. A grip for a golf club comprising:

an elongated tubular elastic member adapted to be fitted on the shaft of said golf club and including elongated vertical grooves in the upper portion thereof, a first diamond-shaped marker on the outer wall of said tubular elastic member, said marker having long and short diagonals and being located in a predetermined position on the circumference of said outer wall with its long diagonal parallel to the longitudinal axis of said tubular member and spaced a predetermined distance from the top end of said tubular member, said first marker defining a position where it is desired that the thumb of one hand of the user lie when the grip is gripped by said one hand, and a second diamond-shaped marker, smaller than said first marker and having long and short diagonals on the outer wall of said tubular elastic member positioned a predetermined distance from and directly below said first marker and at substantially the same position circumferentially on said grip as said first marker having its long diagonal aligned with the long diagonal of said first marker, said second marker defining a predetermined location on opposite sides of which the thumb and forefinger of the user's other hand may lie when the grip is gripped by said other hand and placed over said first hand when the thumb of said first hand is positioned on said first marker.

* * * * *